United States Patent [19]

Rongus

[11] 3,974,773

[45] Aug. 17, 1976

[54] ENERGY BASE FOR SAFETY AND ARMING DEVICE

[75] Inventor: Leo P. Rongus, Washington, D.C.

[73] Assignee: The United States of America as represented by the Secretary of the Army, Washington, D.C.

[22] Filed: June 10, 1975

[21] Appl. No.: 585,736

[52] U.S. Cl. ..... 102/81; 102/70 R
[51] Int. Cl.[2] ..... F42C 5/00; F42C 15/32
[58] Field of Search ..... 102/81, 82, 86, 70 R

[56] References Cited

UNITED STATES PATENTS

| | | | |
|---|---|---|---|
| 3,362,332 | 1/1968 | Campagnuolo | 102/81 |
| 3,362,333 | 1/1968 | Czajkowski et al. | 102/81 |
| 3,367,265 | 2/1968 | Sewell | 102/81 |
| 3,710,716 | 1/1973 | Davis et al. | 102/81 X |
| 3,792,664 | 2/1974 | Campagnuolo | 102/70 R |
| 3,865,143 | 2/1975 | Curto | 102/81 X |

*Primary Examiner*—David H. Brown
*Attorney, Agent, or Firm*—Nathan Edelberg; Robert P. Gibson; Saul Elbaum

[57] ABSTRACT

Mechanical devices which function as energy bases for actuating safety and arming devices are described. A fluidic oscillator mounted in the nose of a missile or other similar device is provided and includes a diaphragm which is driven into oscillation by ram air entering the oscillator. A rod is coupled to the diaphragm and extends from the oscillator housing where it reciprocates at the rate of oscillation of the diaphragm. Mechanical means coupled to the rod are provided to utilize the oscillatory motion of the rod as an energy base for the actuation of a safety and arming device.

8 Claims, 17 Drawing Figures

ENERGY BASE FOR SAFETY AND ARMING DEVICE

RIGHTS OF THE GOVERNMENT

The invention described herein may be manufactured, used, and licensed by or for the United States Government for governmental purposes without the payment to me of any royalty thereon.

BACKGROUND OF THE INVENTION

1. Field of Invention

The present invention relates to a safety and arming device for the warhead of a missile or similar device. More specifically, the present invention relates to a mechanical motion utilization means which utilizes the oscillatory motion of a fluidic oscillator for providing a safing and arming signature to the device.

2. Description of Prior Art

Heretofore additional safing signatures in safety and arming devices utilizing fluidic oscillators of the type disclosed in U.S. Pat. No. 3,772,541 issued to Carl Campagnuolo et al on Nov. 13, 1973 have been provided by devices responsive to setback forces resulting from launching the missile or by mechanical or electronic time delay means.

Although devices of this type perform more than adequately in most cases, they do not take full advantage of the characteristics of the mechanical energy generated by the fluidic oscillator described in the aforementioned patent which is incorporated herein by reference.

SUMMARY OF THE INVENTION

Accordingly, it is a primary object of the present invention to provide a mechanical device which makes use of the mechanical energy generated by a fluidic oscillator to provide an additional safing signature for a safety and arming device.

It is a further object of the present invention to provide a mechanical device coupled to a fluidic oscillator which may be easily fabricated at a low cost for use in the warhead of a missile or similar device.

The objects of the present invention are fulfilled by utilizing the oscillatory motion of a fluidic oscillator as an energy base for mechanically driving a rotating and/or sliding member which effects arming. This provides an additional safing signature function of a safety and arming device.

The fluidic oscillator used in combination with the present invention is of the type described in the aforementioned U.S. Pat. No. 3,772,541 and includes a horn shaped device with a ring shaped air intake nozzle at one end, and a metallic diaphragm emplaced at the other end. An annular nozzle with exhaust ports and a plenum chamber are located substantially in the middle thereof. The fluid medium (air) enters thru the ring shaped nozzle and is forced thru the annular ring into the plenum chamber and sets the diaphragm into oscillating motion to its resonant frequency. Back-up pressure is exhausted through the exhaust ports. An airborne missile going through its trajectory is subjected to environmental air pressures induced by its velocity. The fluidic oscillator is located in the nose of the missile and its air intake nozzle is parallel to the missile's longitudinal center line.

The pressure of the air entering the nozzle intake sets the diaphragm into motion. The oscillating characteristics of the diaphragm are transferred, by means of a rod, attached to the diaphragm, and provide the mechanical energy which is utilized for rotating a rotor or sliding a barrier.

The amplitude of the resonating diaphragm, with 4 PSI laboratory induced air and with its point of rest as reference, is +0.009 inches (downward stroke) and −0.004 inches (upward stroke). The overall travel is 0.013 inches at 1600 CPS with no load. The distance of 0.13 inches of total travel as a mechanical input for a device allows little room for tolerances on component parts. Hence, a design with closely toleranced, precisely fabricated and carefully inspected parts is required in order to utilize the full potential of the oscillatory motion.

The embodiments embraced by the mechanical designs of the present invention provide such a device.

In a first embodiment an elongated rod is coupled to the vibrating diaphragm of the fluidic oscillator. A slider plate is mounted for linear displacement on the rod by means of a sliding clutch. The sliding clutch comprises an aperture in the sliding plate, through which the rod passes, and a leaf spring which overlaps the aperture by a predetermined distance. As the vibration of the diaphragm is transmitted to the rod and causes it to oscillate in a direction longitudinally thereof, the slider plate has imparted thereto an incremental locomotive motion which linearly displaces the plate along the rod. The sliding plate after a predetermined distance of travel will engage and actuate a safety and arming device.

In a second embodiment the sliding clutch of the slide plate comprises in addition to the leaf spring, a steel ball which floats freely between the leaf spring and the oscillating rod. The use of a ball in combination with the leaf spring improves the smoothness and speed of movement of the slider plate along the rod. This enhanced performance also eliminates the need for guide rods for the slider plate.

In a third embodiment the slider plate is replaced by a rotating wheel or disc. The disc is mounted for rotation on a fixed axis and is coupled to the oscillating rod by a roller means. The roller means engages the oscillating rod and imparts rotary motion to the disc as the rod oscillates. The disc or wheel provides mechanical motion to drive a gear train, a geneva gear, a slider, barrier, or other similar device to release a safety and arming device.

BRIEF DESCRIPTION OF DRAWINGS

The objects of the present invention and the attendant advantages thereof become more readily apparent by reference to the following drawings wherein.

DETAILED DESCRIPTION OF DRAWINGS

Figure 1:
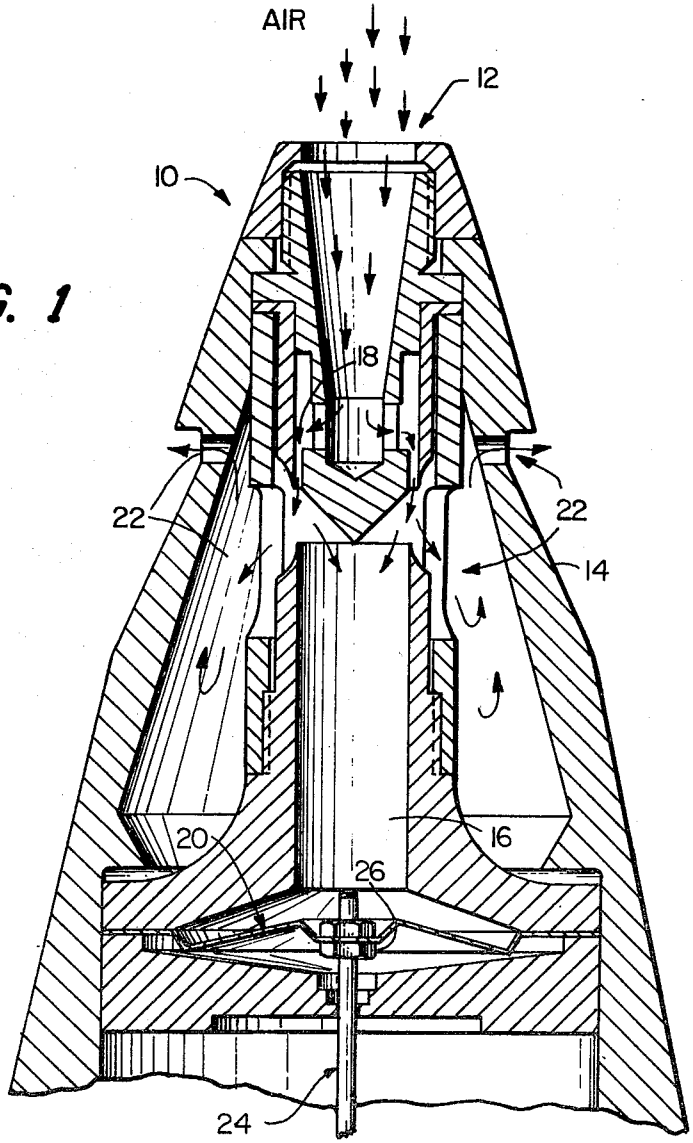
FIG. 1 is a side elevational view in section of a fluidic oscillator for use with the present invention.

Referring in detail to FIG. 1 there is illustrated a fluidic oscillator generally designated 10. Oscillator 10 is of the type described in U.S. Pat. No. 3,772,541 issued Nov. 13, 1973 to Carl Campagnuolo et al. It is intended to incorporate the details of disclosure of that patent herein by reference.

As illustrated in FIG. 1 oscillator 10 generally includes an air intake opening 12, an annular nozzle 18, a plenum chamber 16 and a diaphragm 20 mounted in the nose 14 of a missile. A rod 24 is coupled by suitable means such as jam nuts 26 to diaphragm 20 for purposes to be described in detail hereinafter.

Fluidic oscillator 10 is disposed in the nose of a missile with its longitudinal axis parallel to the missile's longitudinal center line. Accordingly, as the missile becomes air-borne ram air from the atmosphere is forced into oscillator 10 through air intake 12. The ram air passes through annular nozzle 18 into plenum chamber 16 and sets diaphragm 20 into oscillating motion to a predetermined resonant frequency. Back-up pressure is exhausted through exhaust ports 22. The oscillatory motion of diaphragm 20 is transferred to rod 24, so that rod 24 reciprocates or oscillates along its longitudinal axis.

The amplitude of the resonating diaphragm 20 with 4 psi laboratory induced air and with its point of rest as a reference, is +0.009 inches (downward stroke) and −0.004 inches (upward stroke). The overall travel is 0.013 inches at 1,600 cycles per second with no load. The distance of total travel 0.013 inches is utilized as a mechanical energy base as will be described hereinafter. Accordingly, this device allows little room for tolerances of component parts associated therewith.

For a more detailed explanation of the operation of fluidic oscillator 10 reference may be made to the aforementioned U.S. Pat. No. 3,772,541.

Figure 10A:
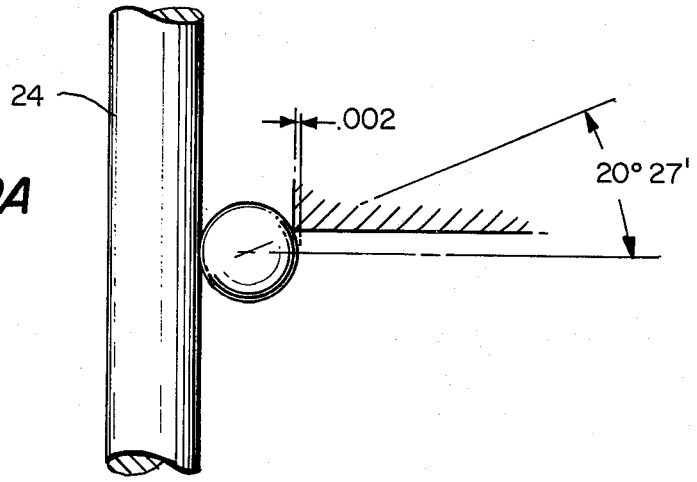
FIGS. 10A and 10B are diagramatic views of another embodiment of the locomotion means of the present invention for use in place of the sliders of FIGS. 2 to 7.
Figure 10B:
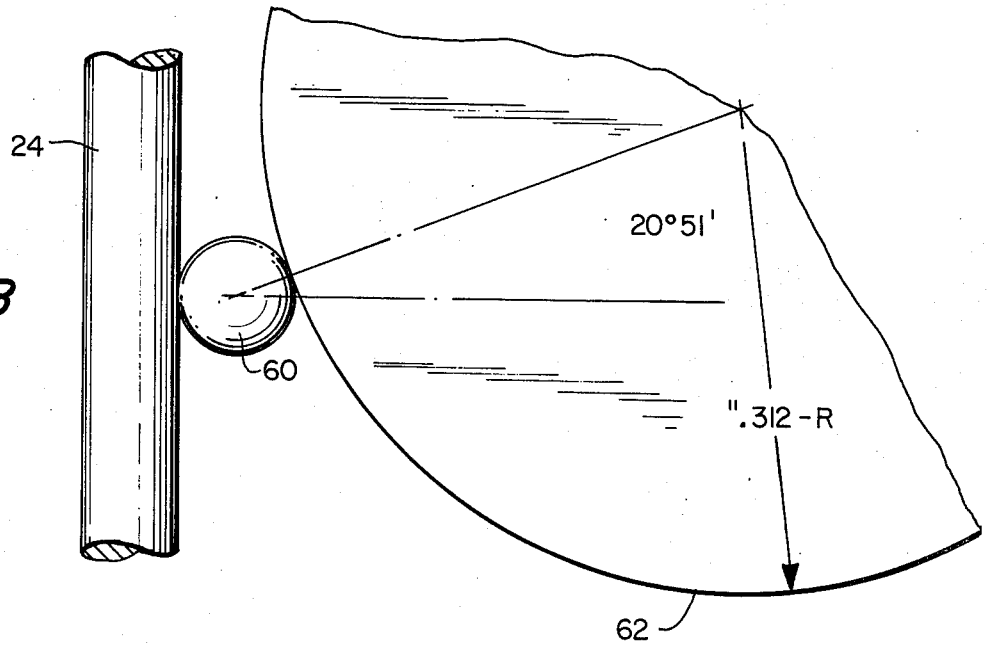
Figure 11:
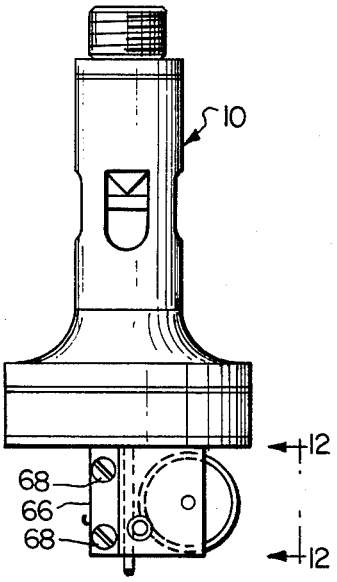
FIG. 11 is a side elevational view illustrating the locomotion means of FIG. 10 of the present invention coupled to the fluidic oscillator of FIG. 1.
Figure 12:
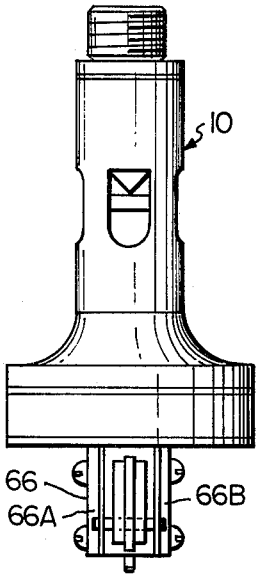
FIG. 12 is an end view of FIG. 11 looking along the lines 12—12.

As will be described in detail hereinafter with reference to FIGS. 2 to 12 the mechanical motion imparted to rod 24 serves as an energy base for actuating a safety and arming device. The energy may be utilized to drive a sliding actuating means, as illustrated in FIGS. 2 to 9, or a rotary actuating means as illustrated in FIGS. 10 to 12. The sliding or rotating actuators are suitably coupled to a safety and arming device.

Figure 3:
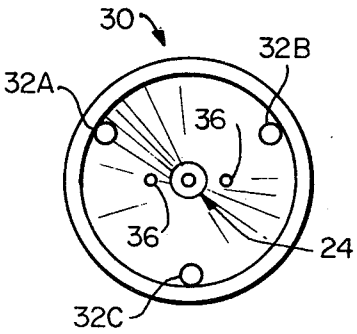
FIG. 3 is a top plan view of the cage structure of FIG. 2.
Figure 2:
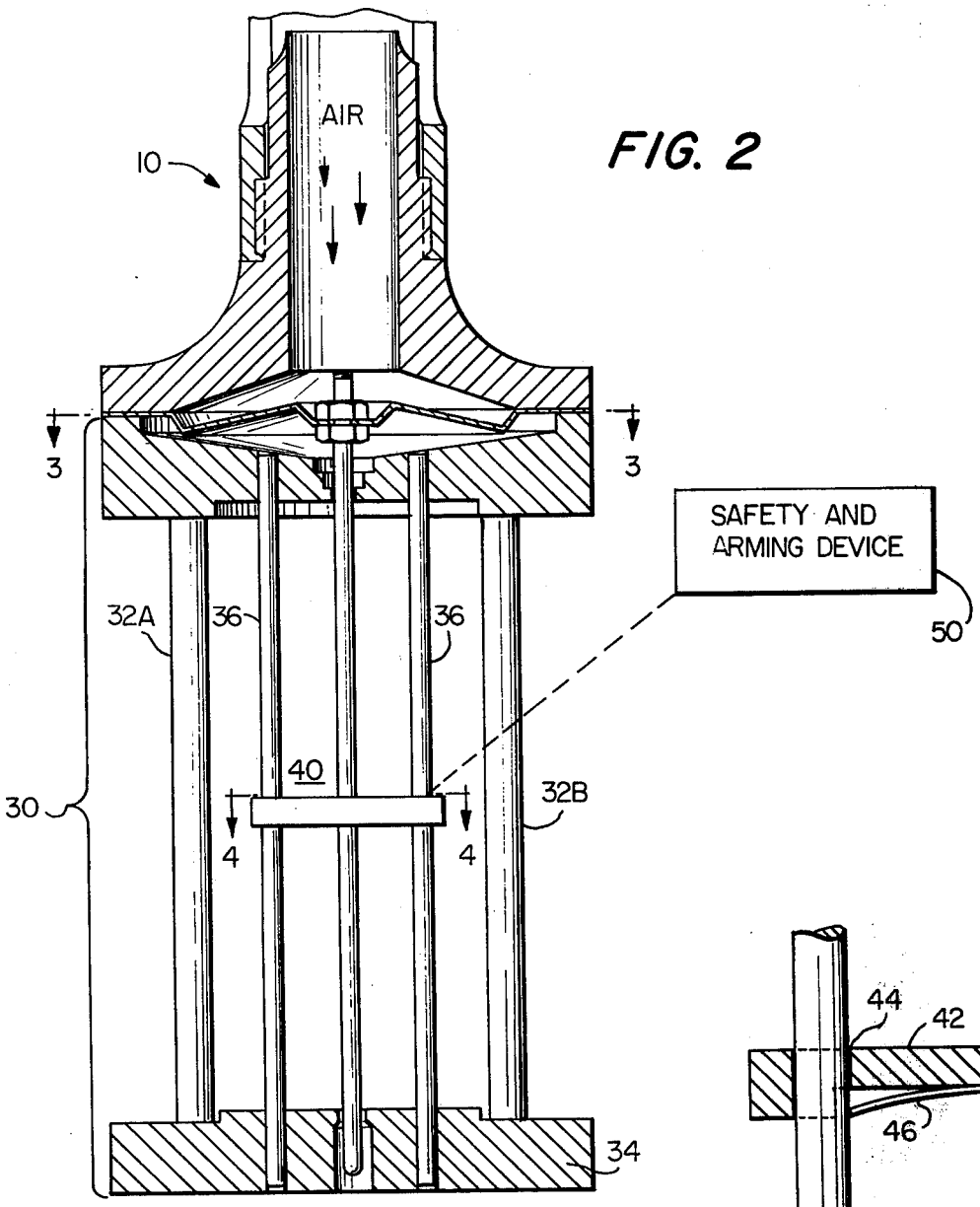
FIG. 2 is a side elevational view of a cage and slider structure of the present invention coupled to the oscillator of FIG. 1.

Referring in detail to FIG. 2 there is illustrated a sliding actuator element generally designated 40 mounted for sliding upward movement on oscillating rod 24. Slider 40 is mounted within a cage 30 extending from the bottom of oscillator 10 and including a base 34 and three upstanding cage ports 32A, 32B, 32C, as shown in FIG. 3. A pair of stationary guide rods 36 are provided within cage 30, which extend from base 34 to the bottom of oscillator 10. Guide rods 36 are stationary and pass through apertures in slider 30 and guide its movement upward through the cage. Guide rods 36 are rigidly secured between base plate 36 and oscillator 10.

As illustrated in FIG. 2 slider 40 is coupled by any suitable means to safety and arming device 50, so that after slider 40 travels a predetermined distance up guide rods 36, safety and arming device 50 is actuated.

Figure 4:
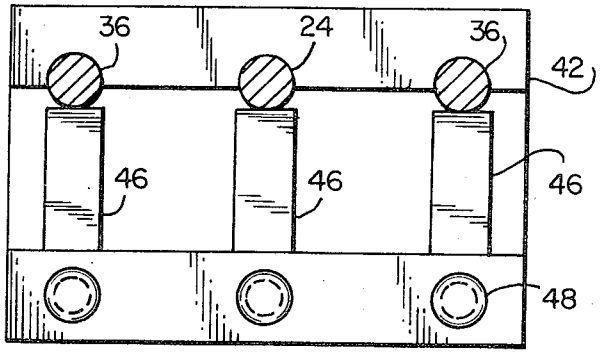
FIG. 4 is a sectional view taken along lines 4-4 of FIG. 2 illustrating a first embodiment of the slider of the present invention.
Figure 5:
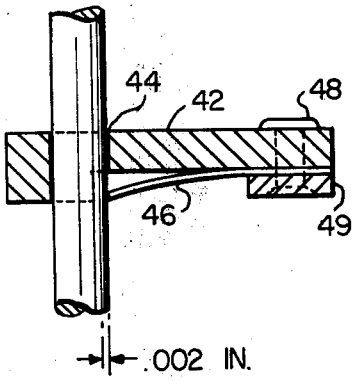
FIG. 5 is a side view in section of the slider of FIG. 1 illustrating the manner in which it is mounted on the rods on which it slides.

A first embodiment of slider 40 is illustrated in FIGS. 4 to 6. As illustrated slider 40 includes a main plate 42 having apertures 44 through which oscillating rod 24 and guide rods 36 pass. A leaf spring 46 is provided and clamped to plate 42 by a rivet 48 and a retaining bar 49. Springs 46 are designed, in a preferred embodiment, to extend 0.002 inches over the respective apertures 44 when rods 24 and 36 are not in the apertures. When the respective rods are inserted in the apertures, as shown in FIG. 5, the springs 46 are bent back to effect a gripping or locking function between the springs and the respective rods.

The slider including plate 42 and leaf springs 46 functions as a sliding clutch which possesses no back lash when reverse motion occurs.

In the preferred embodiment rods 24, 36 each measure 0.0625 inches in diameter and holes 44 are reamed to 0.0630 inches in diameter.

In order to provide a 0.002 inch overlap of the leaf springs a 0.0600 diameter rod can be placed in each aperture. With a 0.0600 diameter rod in the aperture the edge of a leaf spring 46 can be placed against the rod and the spring secured between plate 42 and retaining bar 49. The 0.0600 diameter rod will be forced from the center to the left side of the hole, as viewed in FIG. 5. Thus a 0.002 inch overlap is established.

Figure 6A:
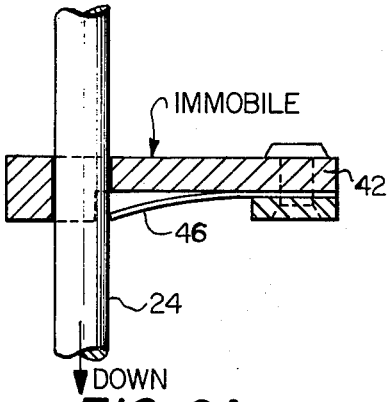
FIGS. 6A to 6D are diagramatic views illustrating the sequence of movement of the slider of FIGS. 4 and 5 with respect to the oscillations of the fluidic oscillator.
Figure 6B:
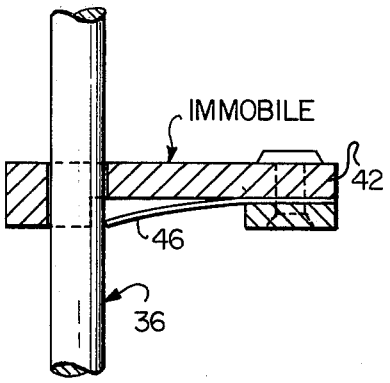
Figure 6C:
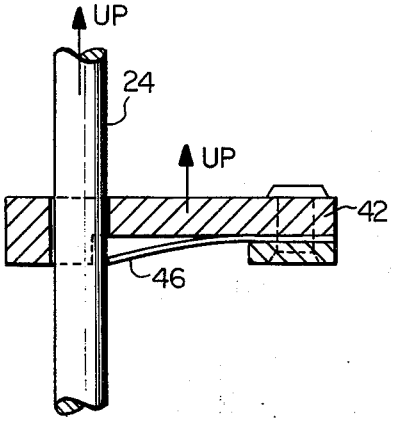
Figure 6D:
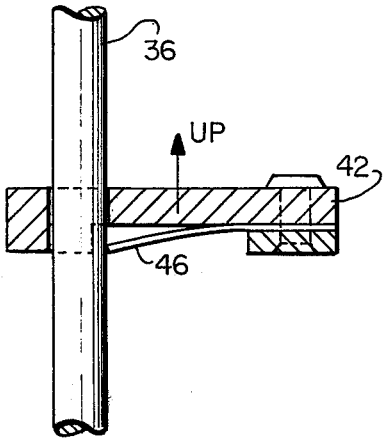

The operation of the slider of FIGS. 4 and 5 is illustrated in FIGS. 6A and 6D.

FIGS. 6A and 6B, respectively, illustrate the condition of plate 42 on oscillating rod 24 and guide rods 36 as oscillating rod 24 is on a downward stroke. As shown in FIGS. 6A, 6B plate 42 is immobile on the downward stroke of rod 24, because leaf springs 46 lock against guide rods 36. In other words leaf springs 46 will permit plate 42 to move up but not down the respective rods.

FIGS. 6C, 6D illustrate the condition of slide 42 on the upward stroke of rod 24. As illustrated the upward motion of rod 24 causes plate 42 to move upwardly on rods 24, 36 an incremental amount for each upward stroke. Accordingly, plate 42 gradually moves up guide rods 42 in a step-like manner with each successive upward stroke of rod 24 until it reaches a predetermined position which actuates safety and arming device 50. Thus, the energy base provided by oscillating rod 24 is utilized to actuate safety and arming device 50.

Figure 7:
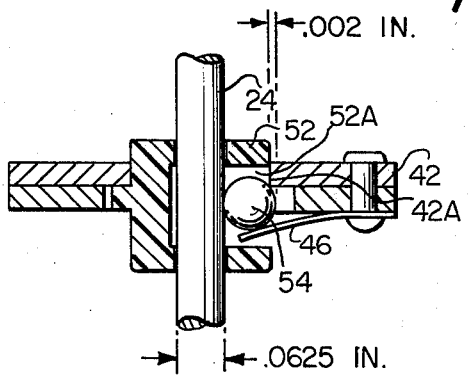
FIG. 7 is a side view in section of a second embodiment of the slider of the present invention.
Figure 8:
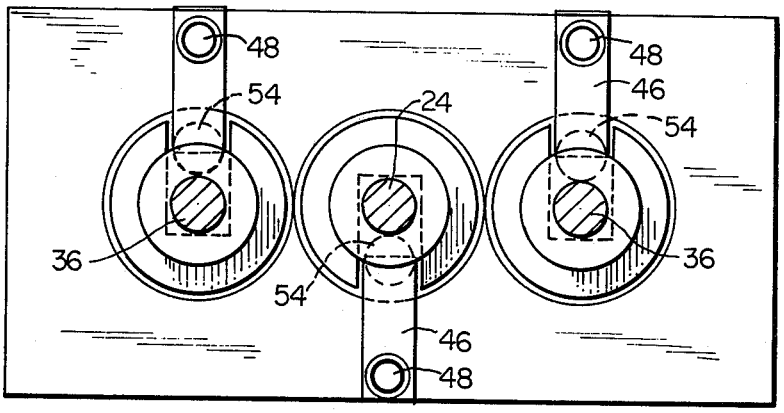
FIG. 8 is a top plan view of the slider of FIG. 7.

A second embodiment of slide 40 is illustrated in FIGS. 7 and 8. In this embodiment plate 42 is provided with a collar insert 52 having a chamber 52A for containing a steel ball 54 which rests on a leave spring 46. This embodiment also performs a locking function on the downward stroke of rod 24 due to a 0.002 inch chordal interference. However, in this embodiment the 0.002 inch chordal interference is provided by edge 42A which acts as a cam and overlaps ball 54 by 0.002 inches, as illustrated in FIG. 7.

In operation downward motion of plate 42 is precluded with respect to the respective rods, since such a motion forces ball 54 tightly between the respective rods and cam edge 42A. However, upward movement of plate 42 can be effected, since ball 54 will roll to the bottom of chamber 52A against spring 46 and out of engagement with cam edge 42A of plate 42. Thus the successive upward strokes of rod 24 impart incremental upward locomotion of plate 42 along the respective rods.

The second slider embodiment of FIGS. 7 and 8 offers certain advantages over the slider embodiment of FIGS. 4 to 6. It has been discovered that it moves more rapidly and smoothly than the first embodiment. Accordingly, it is more stable in its movement. Therefore, as illustrated in FIG. 9 the entire cage 30 and guide rods 36 can be eliminated with successful results.

However, guide rods 36 can be used if desired. As shown in FIG. 8 the locking elements (ball 54) may be staggered on opposite sides of the respective rods for added stability of plate 42.

Figure 9:
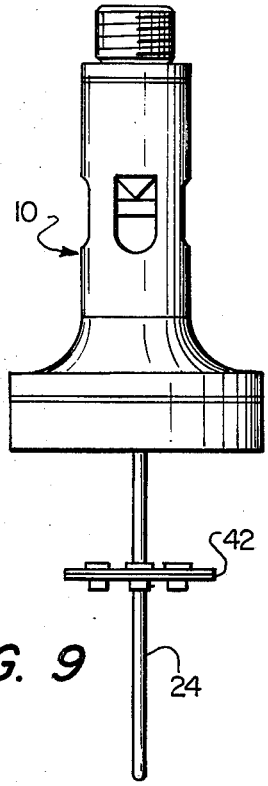
FIG. 9 is a side elevational view of an alternative embodiment for mounting the slider of FIG. 7.

Control in fabrication of the slider embodiment of FIGS. 7 to 9 is accomplished with the use of a No. 14 (0.1820) inch diameter reamer with tolerance control of ±0.0001 inch. The steel ball 54 having a diameter of 0.0625 inches and the steel rods 24, 36 having diameters of 0.0625 inches are precision made, both having a tolerance of ±0.0001 inches. This is a tolerance bed of ±0.0003 inches. It is 15% of the 0.002 inch chordal interference.

Reference 0.0625 diameters of the rod and ball, and mathematically the diameters of 2 balls must be considered to effect the 0.002 interference dimension. That is to say the sum of the diameters of the rod and the 2 balls which is 0.1875 inch minus the diameter of the No. 14 reamer which is 0.1820 inches gives a difference.

A further embodiment of the present invention is illustrated in FIGS. 10 to 13. In this embodiment the energy base provided by reciprocating rod 24 is converted to rotary motion by means of a roller 60, a wheel 62, and a pair of roller support springs 64.

This embodiment makes use of the principles discovered in the ball-locking embodiment of FIGS. 7 to 9. FIGS. 10A and 10B illustrate diagramatically how the principles of the ball locking device are applied to the roller-lock arrangement of this embodiment.

This embodiment utilizes the clutch principle of the ball-locking device to drive a rotating wheel 62 directly. The wheel is in a fixed location and rotates as compared to the ball lock device which displaces itself along the oscillating rod 24. This roller lock design approach is not restricted in operation time with a continuous rotating motion as in the case with linear travel confined by distance. This is an improvement for a good mechanical energy base.

One apparent factor that emerged from the spring and ball-locking devices that sustained reliability is the 0.002 inch overlap dimension used as the gripper feature. The geometry of this gripping action in the ball locking device is utilized in the mechanism where the oscillating rod drives a rotating member, as illustrated by FIGS. 10A, 10B. The 0.002 inch chordal height has an included angle of 40° 54′ on a 0.0312 inch radius ball. Half the angle as shown is 20° 27′ (FIG. 10A). FIG. 10B illustrates a 0.078 inch diameter roller 60, and a 20° 51′ angle which reflects dimensions used in actual hardware fabricated and tested. The angle was projected to a point 0.312 inches from the roller 62 as to accommodate a 0.625 diameter rotating wheel.

The roller-lock device successfully worked with the rotating wheel having a high angular torque, of 0.5 in/oz. at 4 PSI induced air in the fluidic oscillator in a manner to be described hereinafter.

The roller-lock functions with the upward stroke of the oscillating rod 24. The roller 60 between rod 24 and the wheel 62 is subject to high friction and rolls for the upward stroke duration and turns or rotates the wheel 62 counter clockwise. The downward stroke of the oscillating rod removes the driving friction of the roller 60, since roller 60 moves out of engagement with wheel 62. The oscillating rod functioning at 600 to 1000 CPS causes the wheel to rotate with a high angular torque at about 2–4 CPS.

Figure 13:
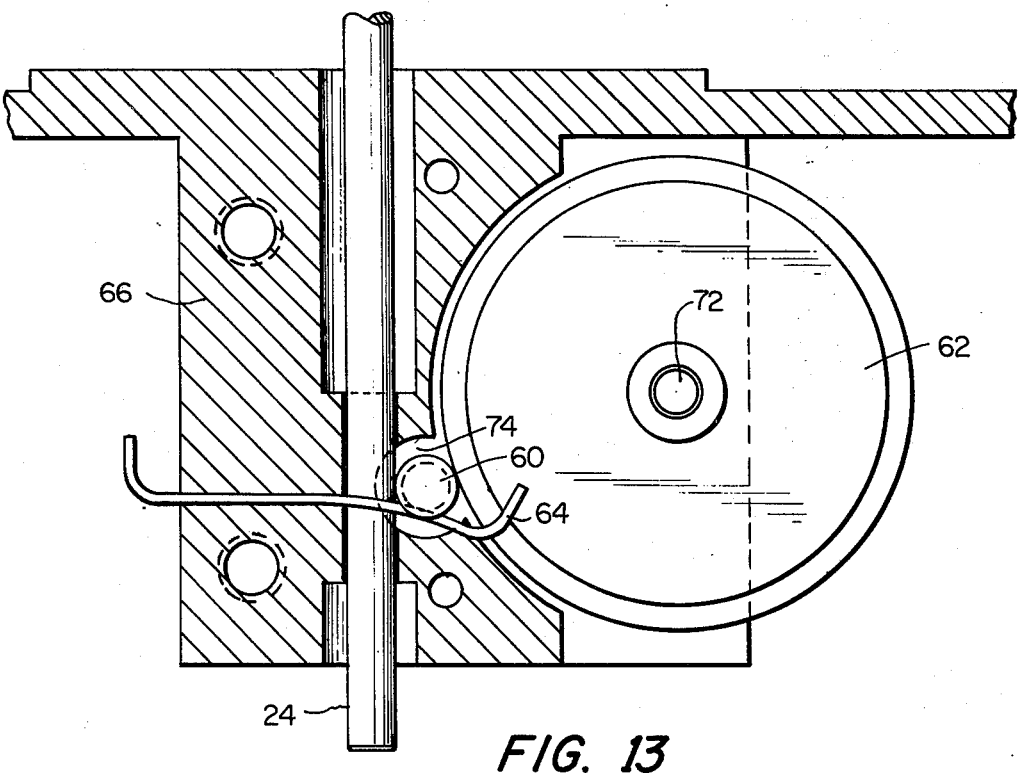
FIG. 13 is an enlarged side sectional view of the locomotion means of FIGS. 10 to 12.

FIGS. 11 to 13 diagramatically illustrate the roller-locking device hardware, roller 60 being held in position by two wire springs one on each side. The relative locations between the oscillating rod and the pivot of the rotating wheel controls the gripping efficiency of the roller in terms of torgue. The physical configuration of the mechanical parts lends itself low cost fabrication techniques such as die castings, stampings and automatic screw machining.

As illustrated in FIGS. 11 to 13 a support housing 66 is provided for roller 60, wheel 62, and springs 64. The housing may include two downwardly extending plates 66A, 66B secured together by bolts or screws 68. Wheel 62 is journaled for rotation in plates 66A, 66B at 72. Roller 62 is contained in a cavity 74 which is larger than the roller diameter to permit floating movement of the roller therein.

Roller 60 is provided with suitable slots adjacent each end for receiving a pair of wire spring members 64. Spring members 64 generally bias roller 60 upwardly against rod 64 and and wheel 62. However, downward movement of rod 24 moves roller 60 against the force of springs 64 toward the bottom of cavity 74. Thus on a downward stroke of rod 24 roller 60 does not contact wheel 62 and no rotary motion is imparted thereto.

The wheel 62 is suitably coupled to a safety and arming device, so that after a predetermined amount of rotation safety and arming device will be actuated to arm a detonator in the warhead of a missile. The coupling means for example may be a gear train, a geneva mechanism, a slider, rotor, or any other suitable device.

I wish it to be understood that I do not desire to be limited to the exact details of construction shown and described, for obvious modifications can be made by a person skilled in the art.

I claim:

1. An apparatus providing an energy base for actuating a safety and arming device comprising:

oscillator means having a diaphragm means which oscillates at a predetermined frequency;

oscillating rod means coupled to said diaphragm means and extending from said oscillator means, said rod means oscillating along the longitudinal axis thereof in response to the oscillation of said diaphragm means; and slider means coupled to said rod means to incrementally travel along said rod means in one direction in response to a first direction of oscillating movement of said rod means.

2. The apparatus of claim 1 wherein said oscillator means is a fluidic oscillator mounted in the nose of an air-borne missile, said diaphragm means being driven by ram air entering said fluidic oscillator.

3. The apparatus of claim 1 wherein said slider means comprises:

a slider plate having an aperture for receiving said oscillating rod means and a cavity adjacent said aperture;

ball means disposed in said cavity;

cam means in said cavity for locking said ball means against rod means in response to a direction of movement of said plate, opposite to said one direction; and leaf spring means having a first end secured to said plate exterior of said cavity and a second free end extending into said cavity for normally biasing said ball means against said cam means.

4. The apparatus of claim 1 wherein said slider means comprises:

a slider plate having an aperture therein for receiving said oscillating rod;

leaf spring means having a first end rigidly secured to one side of said plate and a second end extending a predetermined distance over said aperture.

whereby said leaf spring means permits movement of said plate in only one direction along said oscillating rod means.

5. The apparatus of claim 4 wherein there is further provided stationary guide rod means extending parallel to said oscillating rod means, said slider plate including apertures and associated leaf spring means for each of said guide rod means.

6. An apparatus providing an energy base for actuating a safety and arming device comprising:

oscillator means having a diaphragm means which oscillates at a predetermined frequency;

oscillating rod means coupled to said diaphragm means and extending from said oscillator means, said rod means oscillating along the longitudinal axis thereof in response to the oscillation of said diaphragm means;

a housing having a channel in which said rod means oscillates and cavity means in communication with said channel;

roller means disposed for floating movement in said cavity;

wheel means for engaging said roller means when said roller means is in a predetermined position in said cavity;

means for normally supporting said roller means in said predetermined position and against said oscillating rod means;

whereby movement of said oscillating rod in one direction causes said roller means to rotate said wheel means and movement of said rod in an opposite direction moves said roller means out of engagement with said wheel means.

7. The apparatus of claim 6 wherein said means for supporting said roller means comprises spring means.

8. The apparatus of claim 7 wherein said spring means comprise a pair of wire springs which support opposite ends of said roller means.

* * * * *